United States Patent [19]

Hirose et al.

[11] Patent Number: 4,727,841

[45] Date of Patent: Mar. 1, 1988

[54] SYSTEM FOR CONTROLLING INTERNAL COMBUSTION ENGINE USING KNOCKING AND OVERTEMPERATURE PREVENTING FUEL CORRECTION

[75] Inventors: Kiyoo Hirose; Yoshihiko Matsuda, both of Toyota, Japan

[73] Assignee: Toyota Jidosha Kabushiki Kaisha, Toyota, Japan

[21] Appl. No.: 902,962

[22] Filed: Aug. 29, 1986

[30] Foreign Application Priority Data

Aug. 29, 1985 [JP] Japan ..... 60-188345

[51] Int. Cl.[4] ..... F02D 43/04

[52] U.S. Cl. ..... 123/425; 123/417; 123/421; 123/435; 123/480; 364/431.08

[58] Field of Search ..... 123/425, 435, 415, 416, 123/417, 421, 478, 480, 486; 364/431.05, 431.08, 431.03, 431.04

[56] References Cited

U.S. PATENT DOCUMENTS

| | | | |
|---|---|---|---|
| 4,421,085 | 12/1983 | Nagase et al. | 123/416 |
| 4,442,812 | 4/1984 | Mizuno et al. | 123/480 |
| 4,450,810 | 5/1984 | Wada et al. | 123/425 |
| 4,535,739 | 8/1985 | Kudo et al. | 123/425 |

FOREIGN PATENT DOCUMENTS

| | | | |
|---|---|---|---|
| 54-82531 | 6/1979 | Japan . | |
| 58-5453 | 1/1983 | Japan . | |
| 58-28559 | 2/1983 | Japan | 123/425 |
| 58-158370 | 9/1983 | Japan | 123/421 |
| 58-201970 | 11/1983 | Japan . | |
| 59-141171 | 9/1984 | Japan . | |

*Primary Examiner*—Andrew M. Dolinar

*Attorney, Agent, or Firm*—Cushman, Darby & Cushman

[57] ABSTRACT

In an internal combustion engine where the ignition timing is retarded to avoid knocking and an overtemperature of the engine, a fuel incremental amount is calculated by using a curvilinear function having a positive secondary differential value with respect to the retard amount of the ignition timing.

10 Claims, 10 Drawing Figures

Q/Ne
WOT
1.50ℓ/rev
1.35ℓ/rev
1.20ℓ/rev
Ne: LARGE
Ne: SMALL
Ne=3200rpm
FOTP
1.00
0.80
0.60
0.40
0.20
0
0
10
20
30
40
50
(RETARD SIDE)
IGNITION TIMING (°BTDC)
(ADVANCE SIDE)

SYSTEM FOR CONTROLLING INTERNAL COMBUSTION ENGINE USING KNOCKING AND OVERTEMPERATURE PREVENTING FUEL CORRECTION

BACKGROUND OF THE INVENTION

1. Field of the Invention

The present invention relates to method and apparatus for controlling an internal combustion engine using an overtemperature preventing (OTP) fuel incremental correction.

2. Description of the Related Art

In an internal combustion engine, when the load of the engine such as the intake air amount is increased, thus increasing the temperature of the exhaust gas, a catalyst converter, an exhaust pipe and the like may become overheated and damaged. To avoid such overheating, a so-called OTP fuel incremental correction is carried out.

On the other hand, when knocking is generated and an extremely high temperature and pressure occur in the engine, the engine may become overheated and damaged. Accordingly, a knocking control system (KCS) has been suggested in which the ignition timing is retarded to eliminate the knocking. Also, when the coolant temperature of the engine is extremely high, for example, higher than 100° C., heavy knocking may be generated and the torque of the engine reduced. Accordingly, a correction system has been suggested in which the ignition timing is retarded to reduce knocking and the temperature of the coolant temperature THW. But, when the corrections by retarding the ignition timing due to the knocking control system, and by retarding the ignition timing due to the high engine temperature, are carried out, the temperature of the exhaust gas is further increased. Accordingly, a fuel incremental correction made necessary by the retarding of the ignition timing is carried out in addition to the above-mentioned OTP fuel incremental correction. In the prior art, the above-mentioned fuel incremental correction due to the retarding of the ignition timing is carried out approximately in accordance with the sum of the retarded crank angle (AKCS) of the ignition timing brought about by the knocking control and the retarded crank angle (AHOT) of the ignition timing brought about by the high engine temperature control, or in accordance with a one-dimensional function using each parameter (see: Japanese Unexamination Utility Model Publication (Kokai) No. 59-141171).

When, however, the above-mentioned fuel incremental correction brought about by the ignition timing control is carried out in accordance with the sum of two parameters AKCS and AHOT, or the one-dimensional function defined by each parameter, it is impossible to maintain the temperature of the exhaust gas at a definite value, as will be explained later, and in addition, an excessive amount of incremental fuel is supplied to the engine, thus degrading the emission characteristics, the fuel consumption characteristics, the engine output characteristics, and the like.

SUMMARY OF THE INVENTION

It is an object of the present invention to provide a method and apparatus for controlling an internal combustion engine such as the temperature of the exhaust gas is maintained at an approximately definite value, and the emission characteristics, the fuel consumption, the engine output characteristics, and the like are improved.

According to the present invention, in an internal combustion engine where the ignition timing is retarded in order to avoid knocking and high temperature in the engine, a fuel incremental amount is calculated by using a function having a positive secondary differential value with respect to the retarded amount of the ignition timing.

BRIEF DESCRIPTION OF THE DRAWINGS

The present invention will be more clearly understood from the description as set forth below with reference to the accompanying drawings, wherein.

DESCRIPTION OF THE PREFERRED EMBODIMENT

Figure 1:
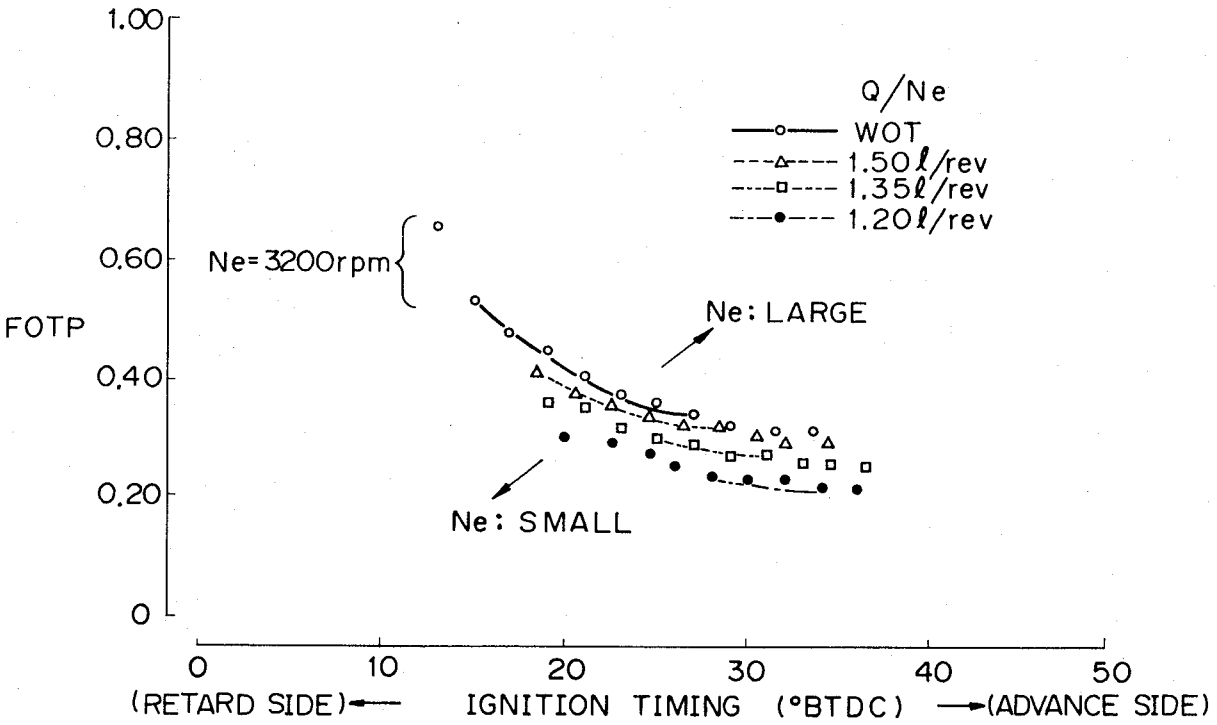
FIG. 1 is a graph showing the required OTP fuel incremental amount (FOTP) according to the present invention.

The inventors found that the required OTP fuel incremental amount FOTP can be experimentally changed as shown in FIG. 1. That is, when the engine load such as the intake air amount $Q/N_e$ per one engine revolution is definite, and the engine speed $N_e$ is definite, the fuel amount FOTP has a concave function having a positive secondary differential value with respect to the retarded crank angle of the ignition timing. Such a concave function is, a quadratic function, an exponential function, and the like. Thus, according to the present invention, the OTP fuel amount FOTP is determined in accordance with a concave function having a positive secondary differential value with respect to the retarded crank angle (AKCS+AHOT).

Figure 2:
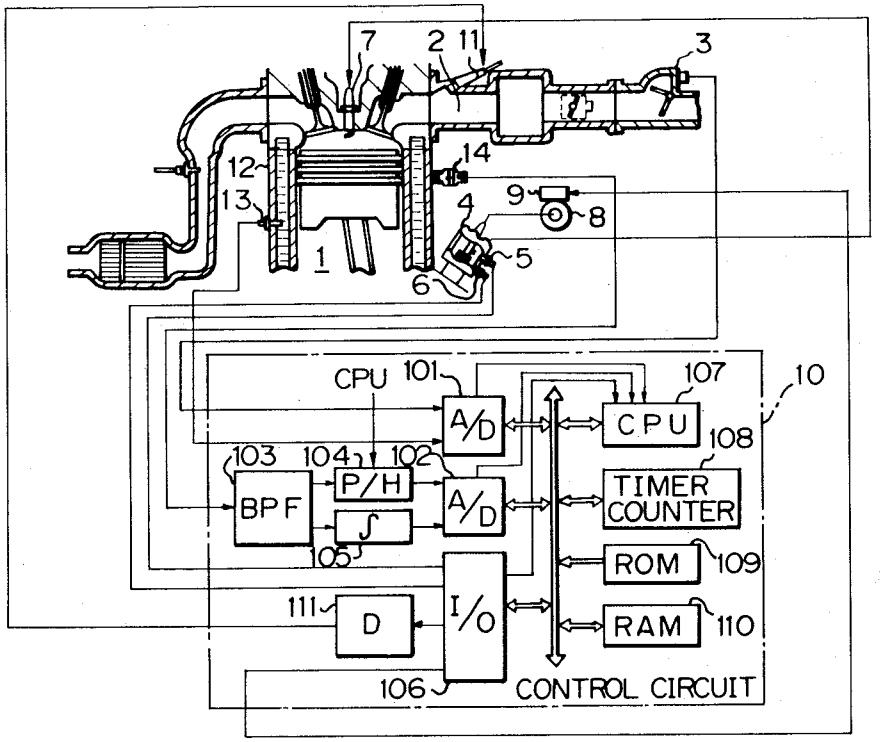
FIG. 2 is a schematic diagram of an internal combustion engine according to the present invention.

In FIG. 2, which illustrates an internal combustion engine according to the present invention, reference numeral 1 designates a four-cycle spark ignition engine disposed in an automotive vehicle. Provided in an air-intake passage 2 of the engine 1 is a potentiometer-type airflow meter 3 for detecting the amount of air taken into the engine 1 to generate an analog voltage signal in proportion to the amount of air flowing therethrough. The signal of the airflow meter 3 is transmitted to a multiplexer-incorporating analog-to-digital (A/D) converter 101 of a control circuit 10.

Disposed in a distributor 4 are crank angle sensors 5 and 6 for detecting the angle of the crankshaft (not shown) of the engine 1. In this case, the crank-angle sensor 5 generates a pulse signal at every 720° crank angle (CA) and the crank-angle sensor 6 generates a pulse signal at every 30° CA. The pulse signals of the crank angle sensors 5 and 6 are supplied to an input/output (I/O) interface 106 of the control circuit 10. In addition, the pulse signal of the crank angle sensor 6 is then supplied to an interruption terminal of a central processing unit (CPU) 107.

Provided for each cylinder is a spark plug 7 connected via the distributor 4 to an ignition coil 8 which is driven by an igniter 9. The igniter 9 is connected to the I/O interface 108 of the control circuit 10. That is, current is supplied to the igniter 9 at a current supply start timing such as at 30° CA before a current supply end timing, thus turning ON the igniter 9. Then, at a current supply end timing, i.e., at an ignition timing, the igniter 9 is turned OFF. Thus, the ignition cycle at one cylinder of the engine is carried out.

Additionally provided in the air-intake passage 2 is a fuel injection valve 11 for supplying pressurized fuel from the fuel system to the air-intake port of the cylinder of the engine 1. In this case, other fuel injection valves are also provided for other cylinders, though not shown in FIG. 2.

Disposed in a cylinder block 12 of the engine 1 is a coolant temperature sensor 13 for detecting the temperature of the coolant. The coolant temperature sensor 13 generates an analog voltage signal in response to the temperature of the coolant and transmits that signal to the A/D converter 101 of the control circuit 10.

Also provided in the cylinder block 12 is a vibration-type knocking sensor 14 for detecting a knocking state of the engine. Note that although the knocking sensor 14 is provided at only one cylinder, this knocking sensor 14 can detect the knocking states of the other cylinders. The output of the knocking sensor 14 is supplied to a band pass filter 103 of the control circuit 10, to pass the frequency component of knocking therethrough. The output of the band pass filter 103 is supplied to a peak hold circuit 104 and an integration circuit 105. The peak hold circuit 104 is used for storing a maximum value a of the output of the band pass filter 103 for a predetermined time period. The integration circuit 105 generates a mean value b of the output of the band pass filter 103. Here, the maximum value a represents a knocking component, and the means value b represents a background value, and accordingly, if $a > K_1 b$ where $K_1$ is a constant, then it is assumed that knocking is occurring. That is, in this case, the background value b is a parameter for determining a knocking reference value $K_1 b$, and this background value is usually changed in accordance with the engine speed $N_e$. The outputs of the peak hold circuit 104 and the integration circuit 105 are supplied to a multiplexer-incorporating A/D converter 102.

The control circuit 10, which may be constructed by a microcomputer, includes a timer counter 108, a read-only memory (ROM) 109 for storing a main routine, interrupt routines such as an ignition timing routine, tables (maps), a fuel injection routine, constants, etc., a random-access memory 110 (RAM) for storing temporary data, a driver circuit 111 for the fuel injector 7, and the like, in addition to the A/D converters 101 and 102, the circuits 103, 104, and 105, and the I/O interface 106.

The timer counter 108 may include a free-run counter, a first compare register, a first comparator for comparing the content of the free-run counter with that of the first compare register, and flag registers for a first compare interruption, ignition control, and the like, thus controlling the current supply start and end operation for ignition. Further, the timer counter 106 may include a second compare register, a second comparator for comparing the content of the free-run counter with that of the second compare register, and flag registers for a second compare interruption injection control, and the like, thus controlling the injection start and end operation.

Interruptions occur at the CPU 107, when the A/D converters 101 and 102 complete an A/D conversion and generate an interrupt signal; when the crank angle sensor 6 generates a pulse signal; and when the timer counter 106 generates a compare interrupt signal.

The intake air amount data Q of the airflow meter 3 and the coolant data THW of the coolant temperature sensor 13 are read every predetermined time period and are then stored in the RAM 110. That is, the data Q and THW in the RAM 110 are renewed at every predetermined time period. The engine speed $N_e$ is calculated by an interrupt routine executed at 30° CA, i.e., at every pulse signal of the crank angle sensor 6, and is then stored in the RAM 110.

The operation of the control circuit 10 of FIG. 2 will be explained with reference to the routines of FIGS. 3 to 6, and 8, and 9.

Figure 3:
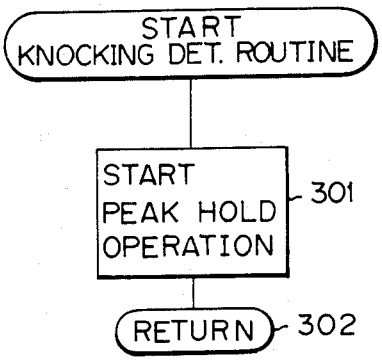
FIGS. 3, 4, 5, 6, 8 and 9 are flow charts showing the operation of the control circuit of FIG. 2.
Figure 4:
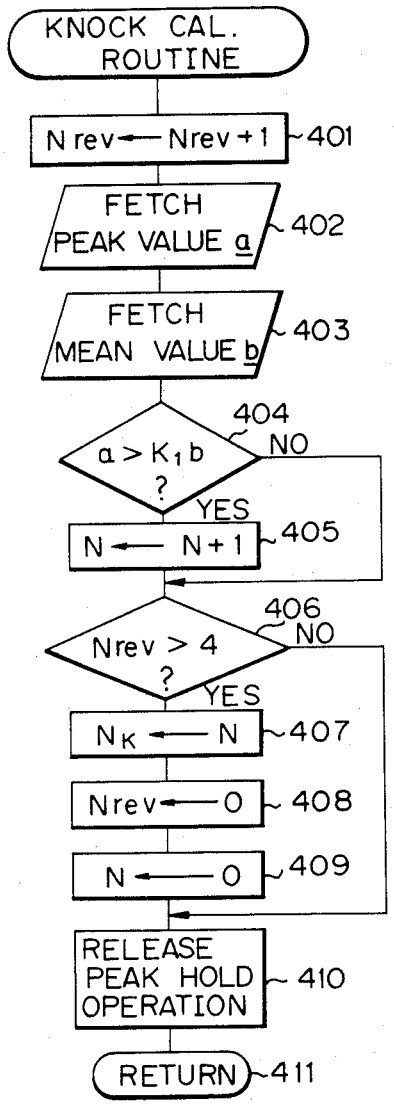

FIG. 3 is a routine for starting a knocking determination, and FIG. 4 is a routine for calculating the frequency of knocking. Both of these routines are carried out at a predetermined crank angle such as 180° CA. For example, the routine of FIG. 3 is carried out at 60° CA before the top dead center (BTDC) of each cylinder, and the routine of FIG. 4 is carried out at the TDC of each cylinder.

In the routine of FIG. 3, at step 301, the peak hold circuit 104 is initiated for operation, and the routine of FIG. 3 is completed by step 302.

In the routine of FIG. 4, at step 401, a counter $N_{rev}$ is counted up by 1. Note that this counter $N_{rev}$ is used for measuring the number of rotations of the engine such as every two rotations (720° CA). That is, these two rotations are detected by determining whether or not $N_{rev}=4$. Then, at step 402, the peak hold value a is fetched from the peak hold circuit 104 via the A/D converter 102, and at step 403, the background value b is fetched from the integration circuit 105 via the A/D converter 102.

At step 404, it is determined whether or not $a > K_1 b$ is satisfied. If $a > K_1 b$, the control proceeds to step 405 which counts up a knocking detection counter N by 1. Otherwise, the control proceeds directly to step 406.

At step 406, it is determined whether or not $N_{rev} > 4$ is satisfied, i.e., two rotations (720° CA) have occurred. If two rotations (720° CA) have occurred, the control proceeds to step 407 which causes a knock number counter $N_K$ to be N. Note that the knock number counter $N_K$ shows the number of knocks per two rotations (720° CA). Then, at step 408, the counter $N_{rev}$ is cleared, and at step 409, the counter N is cleared. If $N_{rev} \leqq 4$ at step 406, the control proceeds directly to step 410.

At step 410, the operation of the peak hold circuit 104 is released, and this routine is completed by step 411.

Figure 5:
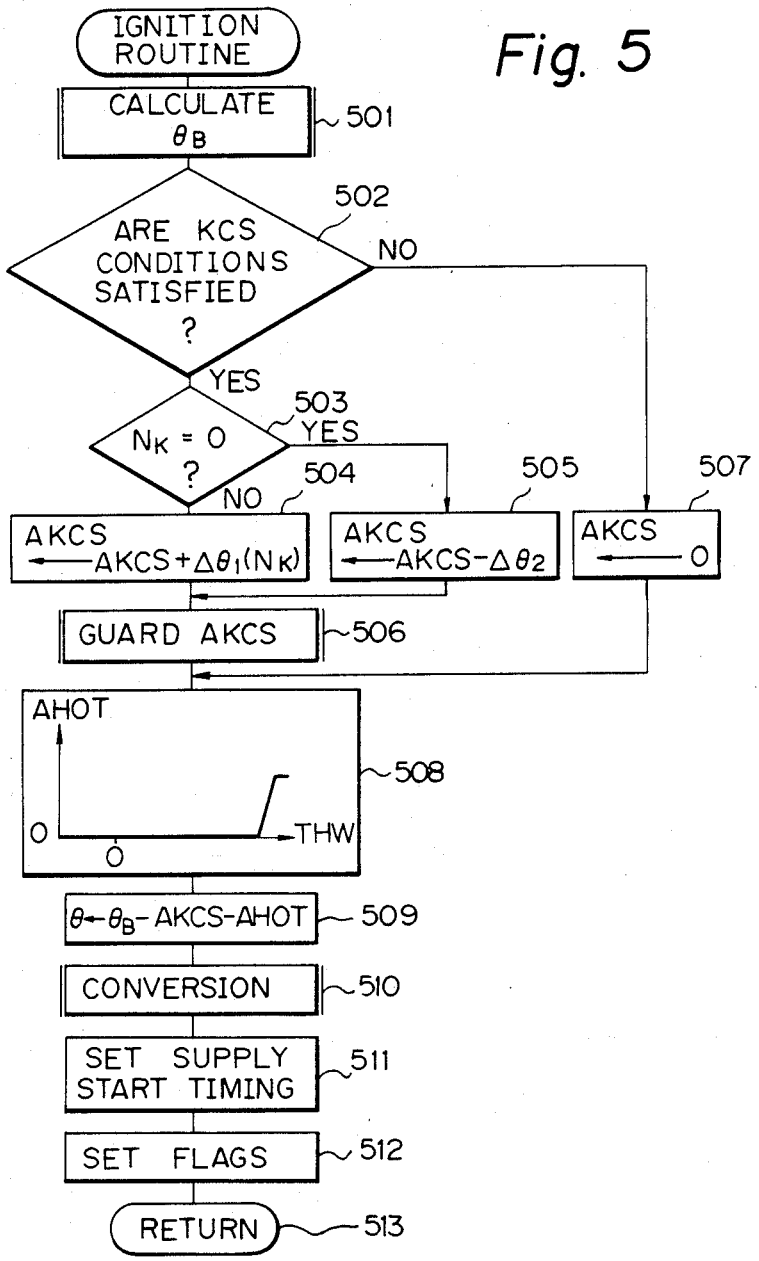

FIG. 5 is a routine for controlling an ignition timing executed at a predetermined crank angle, such as 180° CA, in a four-cylinder engine.

At step 501, a base advance angle $\theta_B$ (°CA) is calculated from a two-dimensional map stored on the ROM 109 using the parameters Q and $N_e$. Then, at step 502, it is determined whether or not the knocking feedback control system (KCS) conditions are satisfied. One of the KCS conditions is that the coolant temperature THW is larger than 60° C. That is, in a cold engine (THW ≦ 60° C.), since the clearance of each portion of the engine is large, the vibration (noise) of the engine for reasons other than knocking becomes large, thus reducing the knocking detection characteristics. Thus, if the knocking feedback control is carried out for a cold engine, an erroneous operation may occur. Therefore, in a cold engine, the control proceeds to step 507, which makes a retarded crank angle AKCS of the ignition timing due to knocking zero, without carrying out a knocking feedback control.

If the KCS conditions are satisfied at step 502, the control proceeds to steps 503 to 506 which carry out a knocking feedback control. That is, at step 503, it is determined whether or not $N_K=0$. If knocking occurs in the engine ($N_K=0$), the control proceeds to step 504 which carries out a retard operation of the ignition timing by $$AKCS \leftarrow AKCS + \Delta\theta_1(N_K)$$

where $\Delta\theta_1(N_K)$ is a retard angle amount determined by the value $N_K$. Contrary to this, if knocking does not occur in the engine ($N_K=0$), the control proceeds to step 505 which carries out an advance operation of the ignition timing by $$AKCS \leftarrow AKCS + \Delta\theta_2$$

where $\Delta\theta_2$ is an advance angle amount. This amount $\Delta\theta_2$ can be either definite or variable in accordance with the time duration. Then, at step 506, the retard angle amount AKCS is guarded by the following range:

$$0 \leq AKCS \leq AKCSMAX$$

where the maximum value AKCSMAX is variable in accordance with the intake air amount $Q/N_e$ per one revolution or the engine speed $N_e$. Thus, the knocking feedback control is completed. Note that the retard angle amount AKCS is stored on the RAM 110.

At step 508, a retard operation of the ignition timing is carried out due to a high temperature of the engine. That is, a retard angle amount AHOT due to a high temperature is calculated from a one-dimensional map stored in the ROM 109 by using the parameter THW as shown in the block of step 508. As a result, when the coolant temperature THW becomes higher than a definite value such as 100° C., the ignition timing is retarded to reduce the engine load, thus reducing the coolant temperature THW.

At step 509, the ignition timing $\theta$ is calculated by $$\theta \leftarrow \theta_B - AKCS - AHOT.$$

Of course, other corrections are introduced as occasion demands. At step 510, the ignition timing $\theta$ is converted into time (corresponding to the current supply end timing $t_e$), and a term of 30° CA is converted into time, which is then stored in the RAM 110. Also, at step 510, a current time supply start time corresponding to a time supply start timing $t_s$ is calculated.

At step 511, the current time CNT of the free-run counter is read out and is set in the D register (not shown) included in the CPU 107. The current supply start time is added to the content of the D register thereby obtaining the current supply start timing $t_s$ in the D register. Then, the content of the D register is set in the first compare register of the timer counter 108.

At step 512, a current supply execution flag and a compare I interrupt permission flag are set in the registers of the timer counter 108. The routine of FIG. 5 is completed by step 513.

Figure 6:
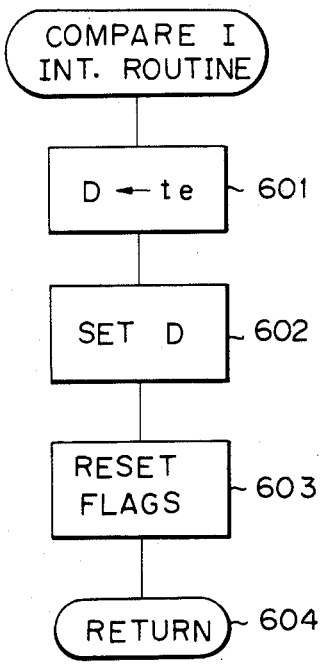

Thus, when the current time CNT of the free-run counter reaches the first compare register, a current supply signal due to the presence of the current supply execution flag is transmitted from the timer counter 108 via the I/O interface 106 to the igniter 9 thereby initiating current supply to the igniter 9. Simultaneously, a compare I interrupt signal due to the presence of the compare I interrupt permission flag is transmitted from the timer counter 108 to the CPU 107, thereby initiating a compare I interrupt routine as illustrated in FIG. 6.

The ignition (spark) will be explained with reference to FIG. 6. At step 601, the time corresponding to 30° CA stored in the RAM 110 is read out and is transmitted to the D register thereby obtaining the current supply and timing $t_e$ in the D register. At step 602, the content of the D register is set in the first compare register of the timer counter 108, and at step 603, the current supply execution flag and the compare I interrupt permission flag are reset. The routine of FIG. 6 is completed by step 604.

Thus, when the current time CNT of the free-run counter reaches the first compare register, a current supply end signal due to the absence of the current supply execution flag is transmitted from the timer counter 108 via the I/O interface 106 to the igniter 9 thereby generating a spark from the spark plug 7. In this case, however, no compare interrupt signal is generated due to the absence of the compare I interrupt permission flag.

Figure 7:
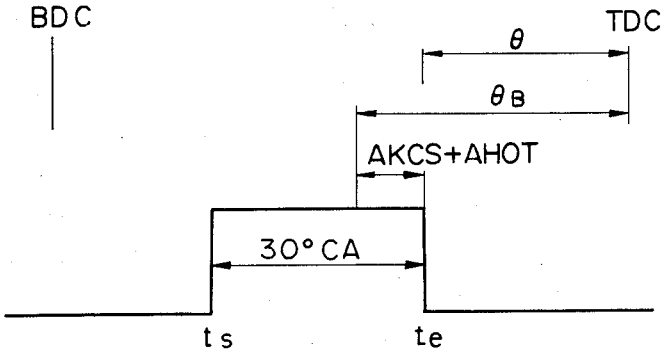
FIG. 7 is a timing diagram explaining the routine of FIGS. 6 and 7.

Thus, the igniter 7 is turned ON before 30° CA of the ignition timing $\theta$, and the igniter 9 is turned OFF at the ignition timing $\theta$. That is, an ignition signal as shown in FIG. 7 is generated.

Note that, at step 404 of FIG. 4, knocking is detected by determining whether or not the strength of such knocking is larger than a definite value. However, light knocks, medium knocks, and heavy knocks can be detected by their strength, and the knock number counters corresponding thereto also can be provided. Also, in this case, at step 504 of FIG. 5, the retard angle amount $\Delta\theta_1$ can be dependent upon the number of light knocks, medium knocks, and heavy knocks. For example, one heavy knock corresponds to three light knocks, and one medium knock corresponds to two light knocks.

Figure 8:
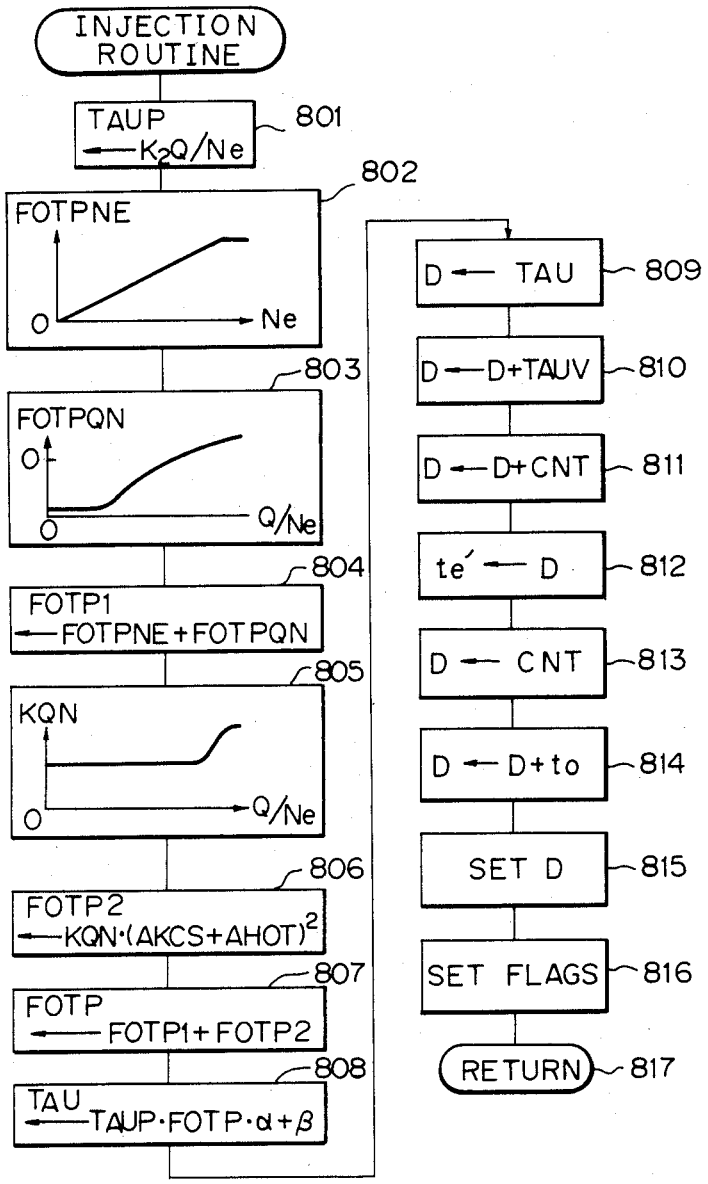

FIG. 8 is a routine for calculating a fuel injection time period TAU executed at every predetermined crank angle. For example, this routine is executed at every 360° CA in a simultaneous fuel injection system for simultaneously injecting all the injectors and is executed at every 180° CA in a sequential fuel injection system applied to a four-cylinder engine for sequentially injecting the injectors thereof. At step 801, a base fuel injection amount TAUP is calculated by using the intake air amount data Q and the engine speed data $N_e$ stored in the RAM 105. That is, $$TAUP \leftarrow K_2 Q/N_e$$

where $K_2$ is a constant.

At steps 802 to 804, a first fuel incremental amount FOTP1 is calculated from the intake air amount Q and the engine load such as the intake air amount $Q/N_e$ per one revolution. This first fuel incremental amount FOTP1 is used for reducing an extremely high temperature of the exhaust gas. That is, at step 802, FOTPNE is calculated from a one-dimensional map stored in the ROM 109 by using the parameter $N_e$ as shown in the block of step 802, and at step 804, FOTPQN is calculated from a one-dimensional map stored in the ROM 109 by using the parameter $Q/N_e$ as shown in the block of step 803. Then, at step 804, $$FOTP1 \leftarrow FOTPNE + FOTPQN.$$

At steps 805 and 806, a second fuel incremental amount FOTP2 is calculated. This second fuel incremental amount FOTP1 is used for reducing the extremely high temperature of the exhaust gas due to the retard angle control of the ignition timing. That is, at step 805, KQN is calculated from a one-dimensional map stored in the ROM 109 by using the parameter $Q/N_e$ as shown in the block of step 805, and at step 806, the retard angle data AKCS and AHOT are read out of the RAM 110, and the second fuel incremental amount FOTP2 is calculated by $$FOTP2 \leftarrow KQN \cdot (IAKCS + AHOT)^2.$$

That is, the second fuel incremental amount FOTP2 is calculated by using a quadratic function of the retard angle of the ignition timing. Note that other functions such as an exponential function can be used at step 806.

At step 807, the fuel incremental amount FOTP is calculated by $$FOTP \leftarrow FOTP1 + FOTP2.$$

Then, at step 808, a fuel injection time period TAU is calculated by $$TAU \leftarrow TAUP \cdot FOTP \cdot \alpha + \beta$$

where $\alpha$ and $\beta$ are correction factors determined by other parameters such as the signal of the intake air temperature sensor, the voltage of the battery (both not shown), and the like.

At steps 809 to 816, a fuel injection execution is controlled. That is, at step 809, the fuel injection time period TAU is set in the D register. At step 810, an invalid fuel injection time period TAUV which is also stored in the RAM 110 is added to the content of the D register. In addition, at step 811, the current time CNT of the free-run counter of the timer counter 108 is read out and is added to the content of the D register, thereby obtaining an injection end time $t_e'$ in the D register. Therefore, at step 812, the content of the D register is stored as the injection end time $t_e'$ in the RAM 110.

Again at step 813, the current time CNT of the free-run counter is read out and is set in the D register. Then, at step 814, a small time period $t_0$, which is definite or determined by the predetermined parameters, is added to the content of the D register. At step 815, the content of the D register is set in the second compare register of the timer counter 108, and at step 816, a fuel injection execution flag and a compare II interrupt permission flag are set in the registers of the timer counter 108. The routine of FIG. 8 is completed by step 817.

Figure 9:
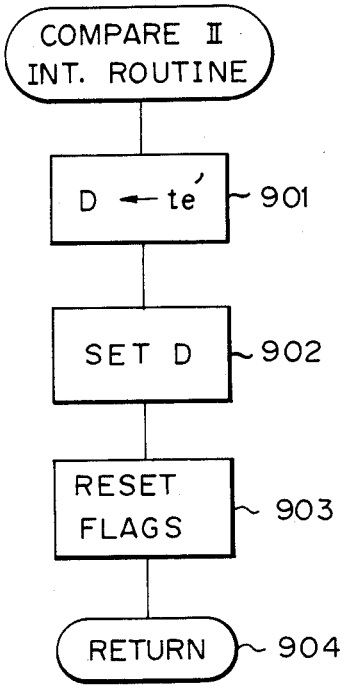
Figure 10:
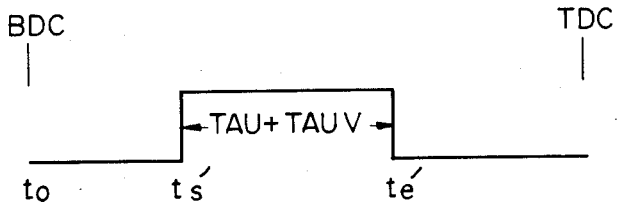
FIG. 10 is a timing diagram explaining the routine of FIGS. 8 and 9.

Thus, when the current time CNT of the free-run counter reaches the second compare register, an injection-on signal due to the presence of the fuel injection execution flag is transmitted from the timer counter 108 via the I/O interface 106 to the driver circuit 111, thereby initiating fuel injection by the fuel injector 7 (see $t_s'$ of FIG. 10). Simultaneously, a compare II interrupt signal due to the presence of the compare II interrupt permission flag is transmitted from the timer counter 108 to the CPU 107, thereby initiating a compare II interrupt routine as illustrated in FIG. 9.

The completion of the fuel injection will be explained with reference to FIG. 9. At step 901, the injection end time $t_e'$ stored in the RAM 110 is read out and is transmitted to the D register. At step 902, the content of the D register is set in the second compare register of the timer counter 108 and at step 903, the fuel injection execution flag and the compare II interrupt permission flag are reset. The routine of FIG. 9 is completed by step 904.

Thus, when the current time CNT of the free-run counter reaches the second compare register, an injection-off signal due to the absence of the fuel injection execution flag is transmitted from the timer counter 108 via the I/O interface 106 to the driver circuit 111, thereby ending the fuel injection by the fuel injector 7. In this case, however, no compare interrupt signal is generated due to the absence of the compare II interrupt permission flag.

Thus, the driver circuit 111 of the control circuit 10 generates an injection pulse as shown in FIG. 10, in which BDC and TDC designate a bottom dead center and a top dead center, respectively, of one cylinder.

As illustrated in FIG. 1, the fuel incremental amount FOTP should be calculated from three parameters, i.e., the engine load (such as the intake air amount $Q/N_e$ per one revolution, the intake air pressure, the throttle opening, and the like), the engine speed $N_e$, and the retard amount of the ignition timing. For this purpose, a three-dimensional map may be required, which requires a large capacity memory, and in addition, a complex program (software) may be required, thus increasing the cost of the system.

As explained before, according to the present invention, since the fuel incremental amount FOTP obtained by using a simple function without three-dimensional maps represents an approximately required amount for controlling the temperature of the exhaust gas, the emission characteristics, the fuel consumption, the engine output characteristics, and the like can be improved.

We claim:

1. A method for controlling an internal combustion engine comprising the steps of:

calculating a base fuel amount in accordance with first predetermined parameters of said engine;

calculating a base ignition timing in accordance with second predetermined parameters of said engine;

calculating a retard amount of said base ignition timing in accordance with third predetermined parameters of said engine;

calculating a fuel incremental amount by using a curvilinear function having a positive secondary differential value with respect to said retard amount of said base ignition timing;

adjusting an actual air-fuel ratio in accordance with said base fuel amount corrected by said fuel incremental amount; and controlling an actual ignition timing in accordance with said base ignition timing corrected by said retard amount of said base ignition timing.

2. A method as set forth in claim 1, wherein said function is a quadratic function of said retard amount of said base ignition timing.

3. A method as set forth in claim 1, wherein said retard amount calculating step comprises the steps of:

calculating a first retard amount of said base ignition timing in accordance with a knocking feedback control;

calculating a second retard amount of said base ignition timing in accordance with the temperature of said engine; and calculating said retard amount of said base ignition timing by adding said first retard amount of said base ignition timing to said second retard amount of said base ignition timing.

4. A method as set forth in claim 1, wherein said fuel incremental amount calculating step comprises a step of correcting said fuel incremental amount in accordance with an engine load.

5. A method as set forth in claim 1, further comprising the steps of:

calculating another fuel incremental amount for reducing the temperature of the exhaust gas in accordance with an engine speed and an engine load; and correcting said base fuel amount by said another fuel incremental amount.

6. An apparatus for controlling an internal combustion engine comprising:

means for calculating a base fuel amount in accordance with first predetermined parameters of said engine;

means for calculating a base ignition timing in accordance with second predetermined parameters of said engine;

means for calculating a retard amount of said base ignition timing in accordance with third predetermined parameters of said engine;

means for calculating a fuel incremental amount by using a curvilinear function having a positive secondary differential value with respect to said retard amount of said base ignition timing;

means for adjusting an actual air-fuel ratio in accordance with said base fuel amount corrected by said fuel incremental amount; and means for controlling an acutal ignition timing in accordance with said base ignition timing corrected by said retard amount of said base ignition timing.

7. An apparatus as set forth in claim 6, wherein said function is a quadratic function of said retard amount of said base ignition timing.

8. An apparatus as set forth in claim 6, wherein said retard amount calculating means comprises:

means for calculating a first retard amount of said base ignition timing in accordance with a knocking feedback control;

means for calculating a second retard amount of said base ignition timing in accordance with the temperature of said engine; and means for calculating said retard amount of said base ignition timing by adding said first retard amount of said base ignition timing to said second retard amount of said base ignition timing.

9. An apparatus as set forth in claim 6, wherein said fuel incremental amount calculating means comprises means for correcting said fuel incremental amount in accordance with an engine load.

10. An apparatus as set forth in claim 6, further comprising:

means for calculating another fuel incremental amount for reducing the temperature of the exhaust gas in accordance with an engine speed and an engine load; and means for correcting said base fuel amount by said another fuel incremental amount.

* * * * *